US005321921A

United States Patent [19]

Holt

[11] Patent Number: 5,321,921

[45] Date of Patent: Jun. 21, 1994

[54] METALLIC RADIUS DRIP CAP FOR GUARDING WINDOW FRAMES

[76] Inventor: Stanley J. Holt, 23519 N. Field, Lake Zurich, Ill. 60047

[21] Appl. No.: 958,659

[22] Filed: Oct. 8, 1992

[51] Int. Cl.[5] ..... E04D 13/00

[52] U.S. Cl. ..... 52/97; 52/288.1; 52/716.2

[58] Field of Search ..... 52/97, 58, 74, 211, 52/288, 287, 716.1, 716.2, 716.8, 717.01

[56] References Cited

U.S. PATENT DOCUMENTS

| | | | |
|---|---|---|---|
| 546,042 | 9/1895 | Van Horn | 52/58 |
| 906,073 | 12/1908 | Sites | 52/74 |
| 1,736,237 | 11/1929 | Whitaker | 52/97 X |
| 2,685,712 | 8/1954 | Tennison | 52/97 X |
| 2,760,241 | 8/1956 | Silverman | 52/97 X |
| 2,912,078 | 11/1959 | Kiehl et al. | 52/97 X |
| 3,008,273 | 11/1961 | Widin | 52/717.01 X |
| 3,139,703 | 7/1964 | Hilt | 52/97 |
| 3,807,103 | 4/1974 | Kautz et al. | 52/58 |
| 4,092,813 | 6/1978 | Eggert . | |
| 4,341,048 | 7/1982 | Minter . | |
| 4,437,284 | 3/1984 | Cribben et al. . | |
| 4,563,846 | 1/1986 | Webb . | |
| 4,909,006 | 3/1990 | Hickman et al. | 52/716.2 X |
| 4,922,661 | 5/1990 | Dallaire et al. . | |
| 5,115,605 | 5/1992 | Butler | 52/211 |
| 5,247,769 | 9/1993 | Becker | 52/716.8 X |

FOREIGN PATENT DOCUMENTS

| | | | |
|---|---|---|---|
| 2476180 | 8/1981 | France | 52/74 |

*Primary Examiner*—Rodney M. Lindsey

*Attorney, Agent, or Firm*—Charles F. Meroni, Jr.

[57] ABSTRACT

This invention relates to an improved architectural radius drip cap method of sealing arcuate wooden and vinyl window assemblies to exterior wall and siding members as found in the construction field through the use of my new metallic multi-flanged radius drip cap which can be used on all known half round and quarter round windows marketed anywhere in the world to the best of my knowledge.

35 Claims, 7 Drawing Sheets

METALLIC RADIUS DRIP CAP FOR GUARDING WINDOW FRAMES

BACKGROUND OF THE INVENTION

1. Field of the Invention:
2. Description of the Prior Art:

In U.S. Pat. No. 4,563,846 a rigid vinyl flashing has been used to seal arcuate window assemblies against an exterior wall. This flashing serves to help locate the window assembly in the wall. The flashing is formed with strategically placed nailing holes for mounting and sealing purposes. If all of these holes are unused by installers and the unused ones are left unplugged by rushed uncareful installers, the flashing will leak like a sieve and cause the window assembler to be left damp so that wood rot can then occur.

SUMMARY OF THE INVENTION

A method of manufacture of a radius drip cap for sealing arcuate window frames when installed on an architectural window assembly previously installed on a building wall comprising uncoiling a strip of aluminum, cutting the strip into aluminum pieces, pressing each strip forming the strip with three stepped flanges including a pair of vertically extending upper and lower cap flanges separated by a horizontally extending cap flange linking the pair of vertically extending flanges together, slitting an uppermost of the vertical cap flanges at transverse intervals forming longitudinally spaced upwardly opening slits, applying a water repellant caulking compound to each of the slits on the upper cap flange to render the slits watertight on the uppermost vertical cap flange for precluding water flow through the slits, and bending each of the flanged strips into a curved shape with each of the cap flanges being thusly curved thus completing the formation of the radius drip cap.

In a building wall having an architectural window assembly mounted thereon with a round exterior trim attached to the building wall about the window assembly, the improvement of an arcuately shaped multi-flanged radius drip cap in attachment with the siding covered building wall, the drip cap being comprised of a metallic material, the arcuately shaped radius drip cap comprised of one piece and having a pair of spaced apart radially inner and outer curved flanges and an intermediate curved flange integrally joined with the pair of spaced apart flanges at opposite front and back areas of the intermediate flange, the radially outer flange having a series of radially extending slits, each of the slits having a watertight caulking compound providing water dams to prevent fluid flow through the slits in the radially outer curved flange, and means attaching the radius drip cap to the siding covered building wall with the radius drip cap protectively encasing the round exterior trim to inhibit water leakage to the trim and to the architectural window assembly.

In a building wall having an architectural window assembly mounted thereon with a round exterior window trim attached to the building wall about the window assembly and with a roundish decorative fascia board structure positioned radially outwardly of the round exterior window trim, the improvement of a first arcuately shaped multi-flanged radius drip cap in attachment with the siding covered building wall covering a radially outer exterior window trim, the drip cap being comprised of a metallic material, the arcuately shaped radius drip cap comprised of one piece and having a pair of spaced apart radially inner and outer curved flanges and an intermediate curved flange integrally joined with the pair of spaced apart flanges at opposite front and back areas of the intermediate flange, the radially outer flange having a series of radially extending slits, each of the slits having a watertight caulking compound providing water dams to prevent fluid flow through the slits in the radially outer curved flange, first attachment means attaching the radius drip cap to the siding covered building wall with the radius drip cap protectively encasing the round exterior trim to inhibit water leakage to the trim and to the architectural window assembly and a second arcuately shaped multi-flanged radius drip cap having a greater radius than said first arcuately shaped multi-flanged radius drip cap, the second cap having caulked slits, and a second attachment means attaching the second arcuately shaped multi-flanged radius drip cap in protective sealed relocation on the round decorative fascia board in water sealed protective assembly therewith.

DESCRIPTION OF THE PREFERRED EMBODIMENT

Figure 1:
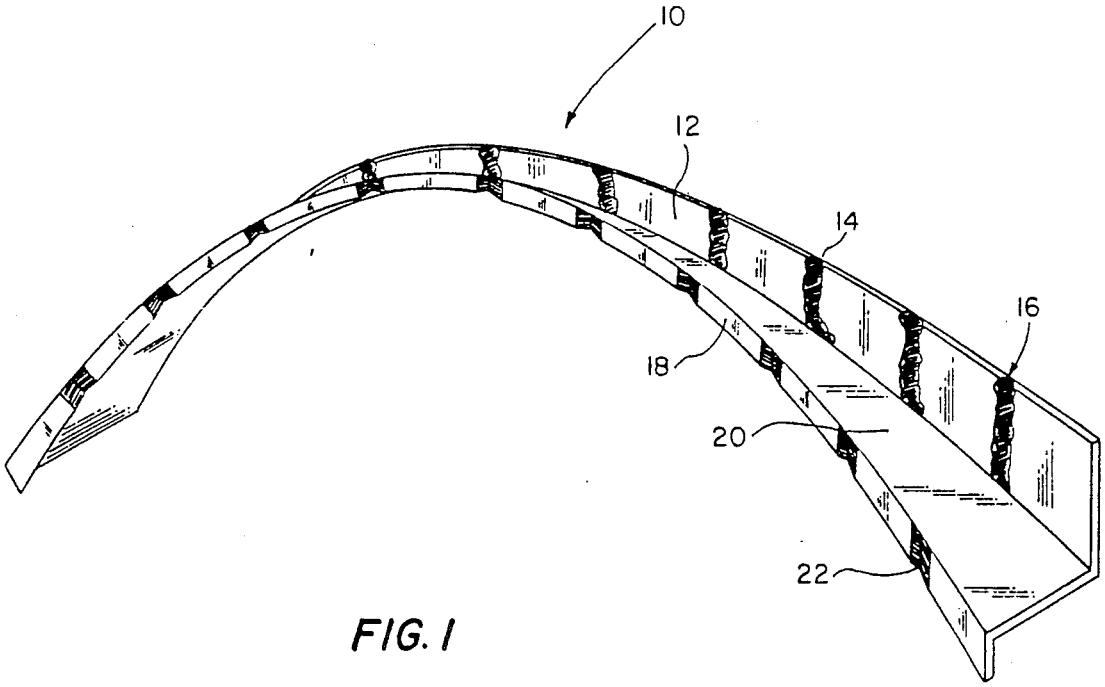
FIG. 1 is a perspective view of a radius drip cap embodying important features of my invention.

The present invention according to certain of its embodiments concerns an arcuately shaped multi-flanged radius drip cap 10, as illustrated in FIG. 1 of the drawings. In my preferred embodiment the drip cap 10 has an arched or a half round shape.

The cap 10 includes a vertical mounting flange 12, provided with longitudinally spaced V-shaped slots 14, in such a manner that a given section or strip may easily be made to conform to the shape that it is intended to protect.

Additionally each slit 14 in the mounting flange 12 is closed and protected by a bead of caulking or sealant 16, or similar sealant material in a manner such that there is no possibility of leakage or subsequent water damage passing through the slits. A horizontal flange 20, provides overhead moisture protection and additionally acts as a support member between the mounting flange 12 and a drip flange 18. The drip flange 18 acts as a means to permit any potential water impingement to run off down its front vertical face or to be channeled through a crimped lower channeled flange area ribbed area 22.

My multi-flanged arcuately shaped radius drip cap 10 has a universal application to all known half round and quarter round window assemblies in the world today which makes the radius drip cap a very useful product to builders and to homeowners. I have found in my work that in the past a serious problem has existed and many homes have been built where water leakage has occurred and is now occurring and by using my new radius drip cap this water leakage problem can be cured on the particular type of window assemblies that it has been made for.

DESCRIPTION OF METHOD OF MANUFACTURE

Figure 2:
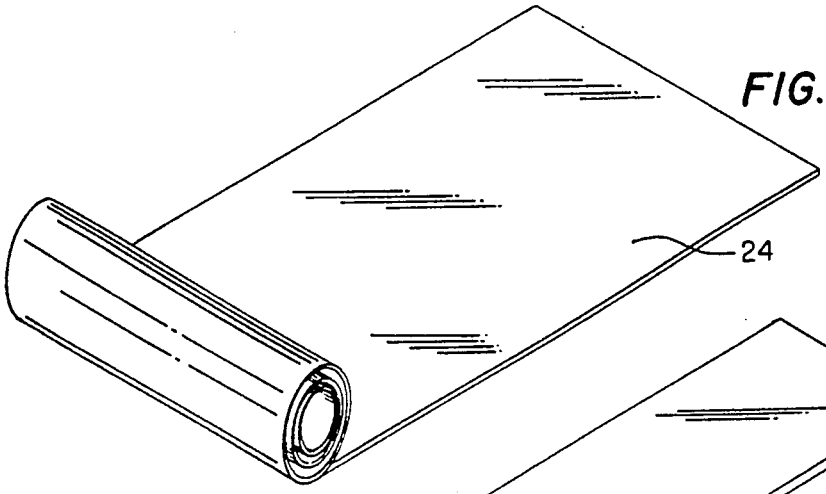
FIG. 2 shows the first step in my method of manufacture of my radius drip cap from a roll or coil of a metallic material such as aluminum which is of a desired thickness.

According to certain important features of my invention, in FIG. 2 of the drawings, I have illustrated a semi-rigid coil or roll of a suitable metallic material such as aluminum by the reference numeral 24. This metallic material may be of approximately 1/32 inch to 1/16 inch in thickness. Material of this type is absolutely water impervious and of a very desirable type for the purpose of maintaining the window frames free of moisture, if properly installed.

I have found that excellent results can be secured where the coil or roll of metallic material is comprised of an aluminum identified as #3105 or equivalent aluminum alloy. This aluminum can have a hardness of the order of H-18. This type of material should possess as a minimum a tensile strength of 28,000 psi. It should have as a minimum yield strength of 24,000 psi. In one preferred embodiment, I have found the thickness of the strip should be of the order of 0.019".

Figure 3:
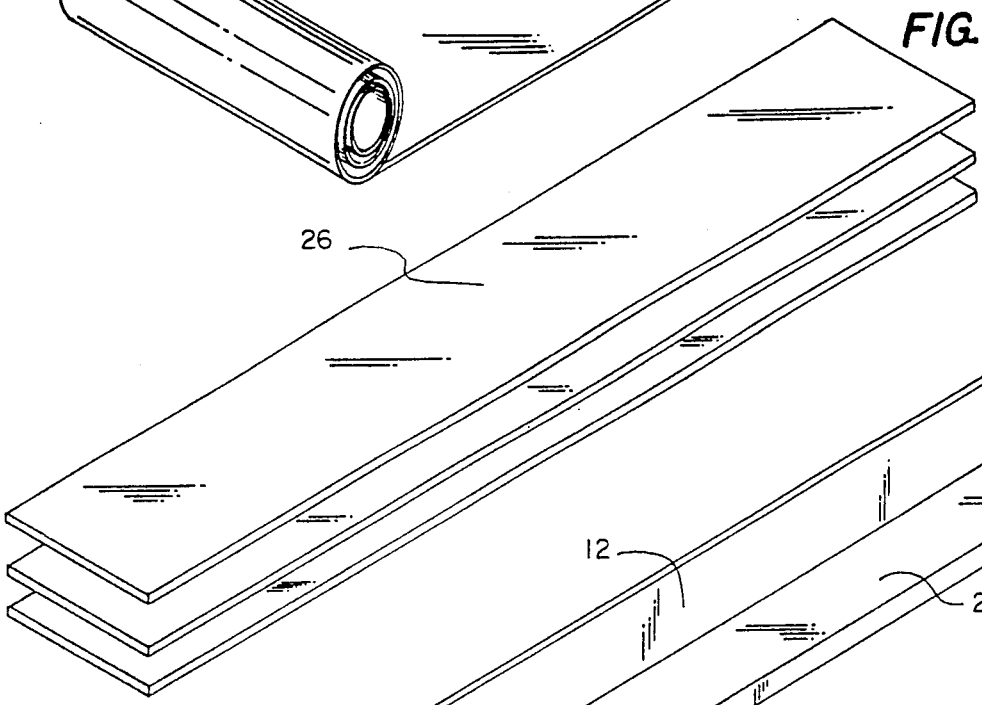
FIG. 3 is a perspective view of strips of material which have been cut from the coil shown in FIG. 2.
Figure 4:
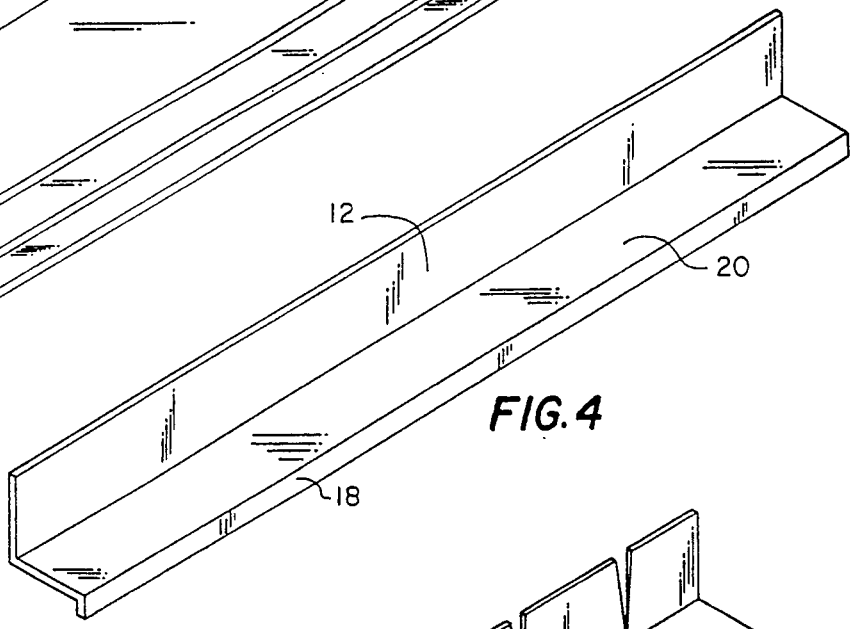
FIG. 4 is a perspective view of a partially formed radius drip cap before it has been shaped to a desired arcuate configuration in accordance with my method.

In FIG. 3, I have shown the way in which the coil strip 24 has been into parallel sided aluminum pieces 26. Preferably, the coil or roll of aluminum 24 can be cut into lengths of ten feet. Then the pieces of ten foot length are further cut to a proper size corresponding to the size of the drip cap 10 that is to be made.

These pieces 26 are then put into a suitable brake press of a known type and these pieces are each individually formed so as to provide it with a multi-step flanged construction. When formed, the strip 26 after being formed with multi-step flanges includes the mounting flange 12, the horizontal support flange 20, and the front vertical flange 18. It will be seen that the horizontal support flange 20 is connected front and rear with the flanges 16 and 12 respectively. The multi-step flange construction just described is preferably dimensioned so that the mounting flange 12 will have a height of 1½", the horizontal support flange 20, will have a width of approximately ¾", and the front vertical flange 18 will have a height of approximately ½". These dimensions can be varied, but it has been found that by sizing the multi-step flange construction with the dimensional shape just described, that the drip cap 10 manufactured therefrom will be usable on a substantial number of the windows that are now being installed in newly constructed buildings and homes in the U.S.A. today.

Figure 5:
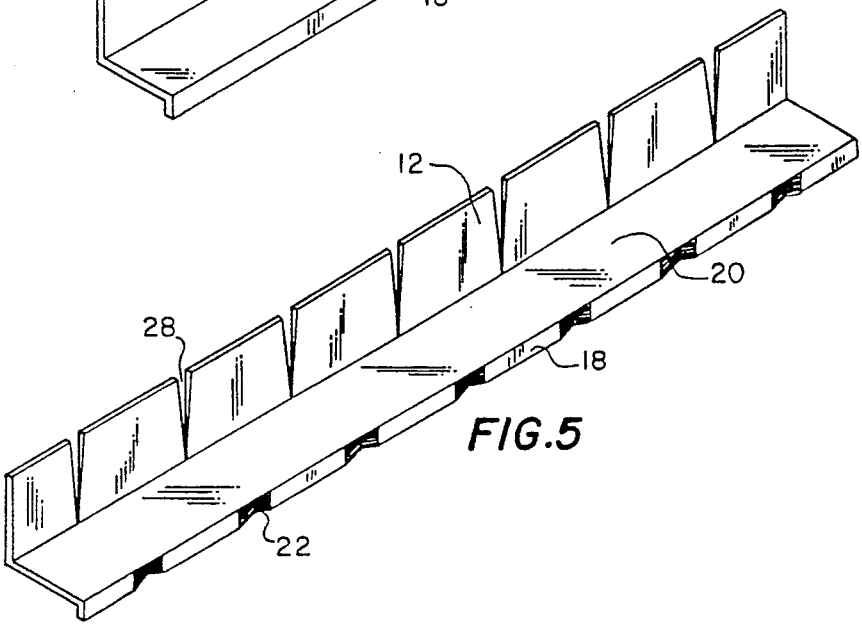
FIG. 5 is another perspective view of my partially formed radius drip cap showing it with upper and lower vertical flanges having been slit and crimped as shown.
Figure 6:
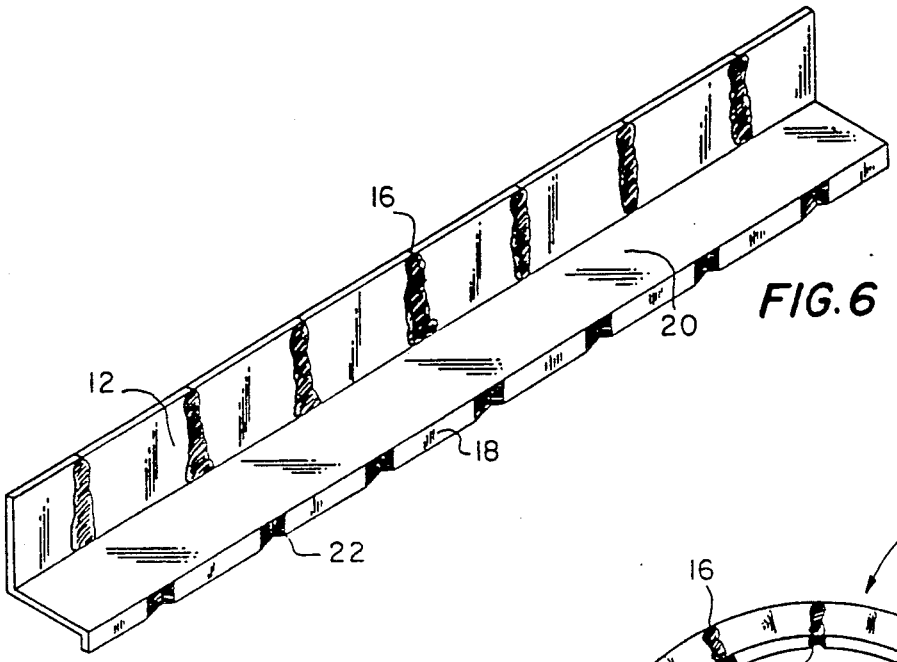
FIG. 6 is a further perspective view of the partially formed radius drip cap shown in FIG. 5 only with the V-shaped slits having been closed by applying a caulking compound thereto.

The next step in my method of manufacture is to slit the vertical mounting or nailing flange 12 to provide it with a series of slits indicated generally at 28. These slits are now hand cut but could be machine cut, if desired in which event the step of rolling the slit edges flat could be eliminated possibly by slitting a series of edges with press knives striking a slotted bed plate (not shown) to slit the strips 26. After the slits are formed, a suitable roll can be rolled over the slits to push down the hand cut edges of the slits to flatten them so as to lie in a common flat plane should the edges be turned or bent in the cutting step as shown in FIG. 5. This slit flange 12 is ultimately caused to be bent to snap the slits apart a distance of about 2½" at the outside edge of the slit to thereby form the slits 28 into V-shapes so that the piece will have a series of V-shaped slits extending along the length of the thus formed strip 26.

Figure 7:
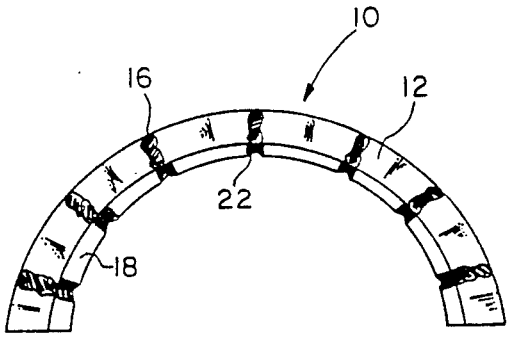
FIG. 7 is a front view of a finished radius drip cap after the partially formed strip or section or cap as shown in FIG. 6 has been bent or shaped into an arcuate form of a predetermined radius.

After the slits 28 are formed but not yet opened into V-shapes, elastomeric sealant such as XL-150 or silicone is applied to each of the slit areas, and a time is then allowed to elapse of at least fourteen hours. The drip cap 10 can be crimped after the sealant has reached a state where it adheres to the edges of the slit like a glue and is thus expandable as the slits are reformed into V-shapes as shown diagrammatically in FIG. 5. Once the sealant 16 has started to cure, then it is time to start a crimping process of the front vertical flange 18 for a novel dual purpose. To this end, the front flange 18 is then crimped at longitudinally spaced intervals to form the channeled flange area indicated generally at 22 while at the same time causing the multi-flanged strip to assume its ultimate curved shape before the sealant has cured so that the sealant can expand as the slit areas of the nailing flange 12 are reshaped each into a V-shape configuration sealed by the seal after it finally cures. With the preferred caulking compound I have found from start to finish that it may take as long as three (3) days before the cure has been completed sufficient to allow the caps 10 to be shipped to prevent them from sticking together. They can be shipped sooner if they can be held apart from one another. The flange 18 can either be crimped by means of a crimping tool or it can be crimped by using a sheet metal crimping machine, as desired. By proceeding with the crimping step before the sealant has started to cure, the crimping step can be utilized to create the arcuate shape to be imparted to the drip cap 10 so that the sealant can continue to expand before total cure occurs. The crimped areas actually are in the form of channels and hence I have also described them as comprising channels 22. It will further be seen that the channels 22 are vertically aligned with a corresponding one of the slits 28 directly to the rear of the horizontal support flange 20 to provide an attractive configuration when viewed from a front side of a thus formed strip or piece of aluminum material. After the caulking or sealant material applied in the V-shaped slits 28 has cured it serves to provide a watertight or water impervious seal at each of the areas where the V-shaped slits 28 are located and the finished product or radius drip cap 10 is illustrated in FIG. 7 ready for installation.

Different materials can be used for the purpose of closing the slits 28. The preferred material is Alcoa XL-150 elastomeric sealant, which meets Federal specification TT-S-001657, Type 1; ASTM C920-79 types Grade NS, Class 12.5 use NT AAMA 1407.1. Other alternatives are listed below as follows:

Sealant NPC
Solar seal #900
Meets all the requirements of TT-S-230C.

Figure 8:
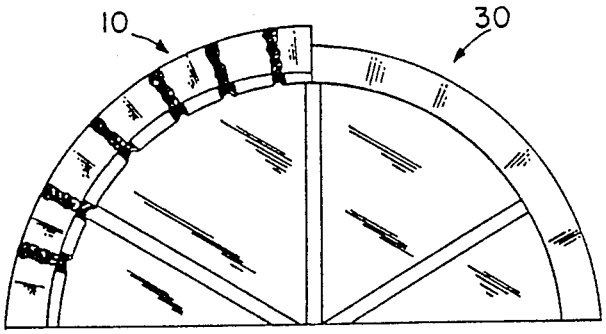
FIG. 8 is a front elevation of my radius drip cap mounted on one side of an architectural window assembly and with the window assembly being in readiness to receive a second drip cap to complete the covering of a frame for the architectural window assembly.
Figure 9:
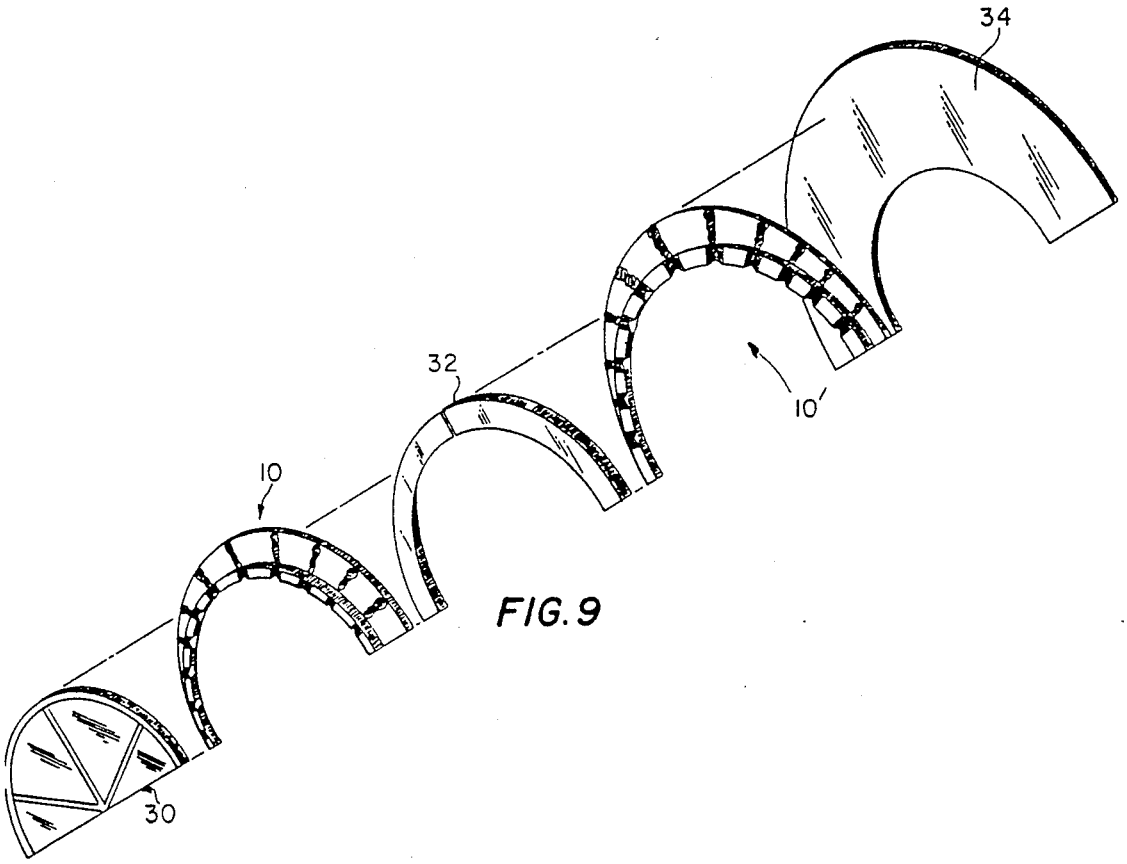
FIG. 9 is an exploded view of the drip cap showing the manner in which the components of an architectural window assembly can be assembled with the drip caps.

Sealant OSI
RS-225 Rubber Sealant
Meets Federal Specs TT-S-001657 Type 1
ASTM C 920-86 Type S NS NT One section of the radius drip cap 10 is then formed in an arcuate half round shape having a pre-determined radius as required for the application of the radius drip cap 10 to a designated frame of a prescribed radius on an architectural window assembly as shown at 30 in FIG. 8. In other words, the radius of the drip cap 10 is sized in accordance with the dimension of the frame that peripherially bounds the architechtural window assembly 30. This radius may vary according to the specifications of the window frame on which it is to be mounted.

The stepped shaped piece shown in FIG. 5 can be formed from a relatively non-curved form by means of conventional roller dies with the arcuately shaped radius drip cap indicated at 10 in FIG. 7.

If desired, it is also contemplated that the radius drip cap 10 can be formed in an extrusion process. Where the drip cap 10 is formed from a suitable aluminum with properly cured caulking material having been applied to the preslit flange 12, excellent results are attainable when installed by using fasteners or nails 54 hammered through the nailing flange 12 into the exterior siding or wall of the building over the architectural window assembly 30.

My radius drip cap 10 should be sealed at **16*a* by using caulking material between siding 34 of the building and the so called nailing flange 12 so that a watertight seal will exist. The nailing flange 12 should also be nailed in adjacency to the area where the caulking material 16*a* is applied. In the industry, the term that is referred to and is used for describing the adding of the caulking material behind the nailing flange 12 is "back caulking". The same or similar caulking material used for the seal 16 can also be used for the seal 16*a*. I do believe that it is preferable to nail the nailing flange 12 to the building to insure that there is a solid connection between the nailing flange and the building. As stated previously, the nailing flange 12** should also be "back caulked".

PRODUCT DESCRIPTION AND SPECIFICATIONS

The drip cap 10 is recommended for wood, aluminum, and vinyl windows. It is also used on wood trim around the radius of windows. On wood windows the drip cap 10 prevents wood rot, and on the wood trim it prevents wood rot and plywood warping. On aluminum windows the drip cap prevents seam leaks and jumps the nailing flange, and on vinyl windows the drip cap jumps the perforated nailing flange.

PRODUCT USE

On the radius drip cap 10 when of a $\frac{3}{4}''$ construction the back nailing flange 12 may vary from $1\frac{1}{8}''$ to $1\frac{3}{4}''$. A $\frac{3}{4}''$ will always be used on window wood trim, thus it does not have to cover the window nailing flange 18. The face drip edge may vary, 1/16" will be $\frac{1}{2}''$ On 1", $1\frac{1}{4}''$, $1\frac{1}{2}''$ the desired size of the back nailing flange will always be $1\frac{3}{8}''$ to $1\frac{3}{4}''$, thus jumping the nailing flange of the described windows.

The nailing flange of the radius drip cap 10 must be sealed to the main wall. Back caulk of the drip edge is recommended.

PRODUCT SIZES

According to my experience I have found, as follows:

a 6 foot piece will cover up to 48 inch half radius;
a 10 foot piece will cover up to 80 inch half radius;
a $\frac{3}{4}''$ drip cap fits all standard wood trim;
a 1" drip cap fits most aluminum and vinyl windows; and
a $1\frac{1}{4}''$ drip can is mainly for wood windows.

The desired sizes of the drip cap 10 can be determined according to measurements taken of the window assembly on which the drip cap is to be mounted.

Figure 10:
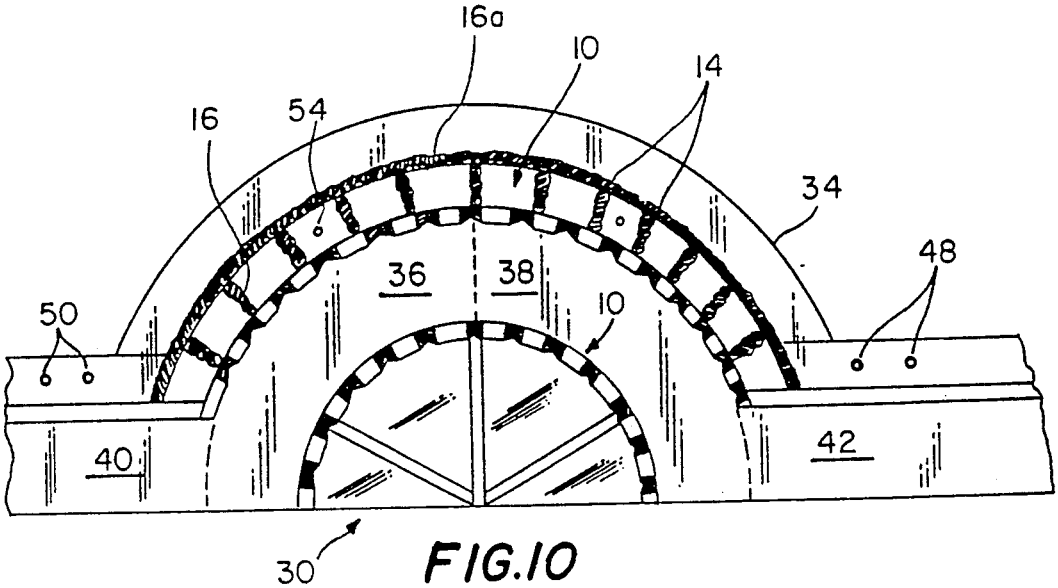
FIG. 10 is enlarged fragmentary front elevation of an architectural window assembly with a pair of the radius drip caps mounted thereon with the caulking being omitted.
Figure 11:
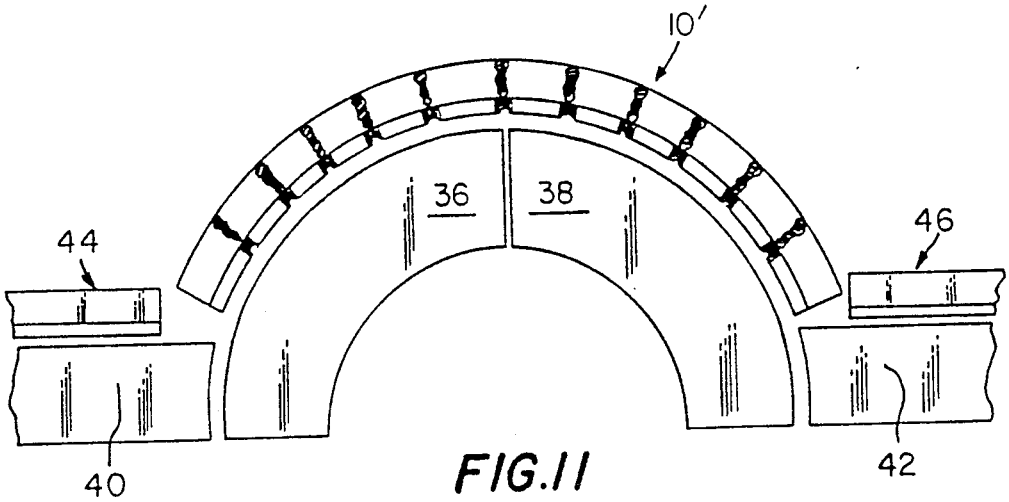
FIG. 11 is a further exploded view showing how the components of the architectural window assembly and the radius drip caps can be oriented or positioned for assembly together.

In FIGS. 10 and 11 I have shown different sized radius drip caps 10,10 having different diameters which are diagrammatically illustrated as being mounted on the exterior building wall 34. Essentially, the window assembly 30 is provided with a decorative and yet utilitarian structure which surrounds the window assembly 30. This decorative structure includes arcuately shaped decorative window trim pieces or fascia 36 and 38 as also shown in FIG. 11. The window 30 fits inside of the fascia 36,38 as shown in FIG. 10. Mounted at radially outer sides of the window trim or fascia 36 and 38 are a pair of flat fascia boards or pieces 40,42. Mounted upon the pieces 40 and 42 are a pair of flat uni-planar drip caps 44 and 46 which are adapted to be nailed by nails 48,50 as shown in FIG. 10 to an exterior building wall such as is illustrated at 34 in FIG. 10 or to the exterior building wall sheathing 32. When the components are assembled as shown in FIG. 1, the inner radius drip cap 10 is mounted on the window assembly 30 and the outer radius drip cap indicated at 10' is mounted on the decorative window trim pieces or fascia 36,38 and nails 54 are nailed through the nailing flange to secure the drip cap 10' to the exterior building wall 34. The outer edge of the radius drip cap 10' is caulked at 54 in the same way as the inner radius drip cap 10 is caulked so that water cannot get behind and between the fascia 36,38 and the building wall 34 to cause wood rot. The caulking is also provided between the inner radius drip cap 10 and the fascia 36,38 to prevent wood rot in this perimeter area of the radius drip cap and also about the window assembly 30 as shown in FIG. 8.

Figure 14:
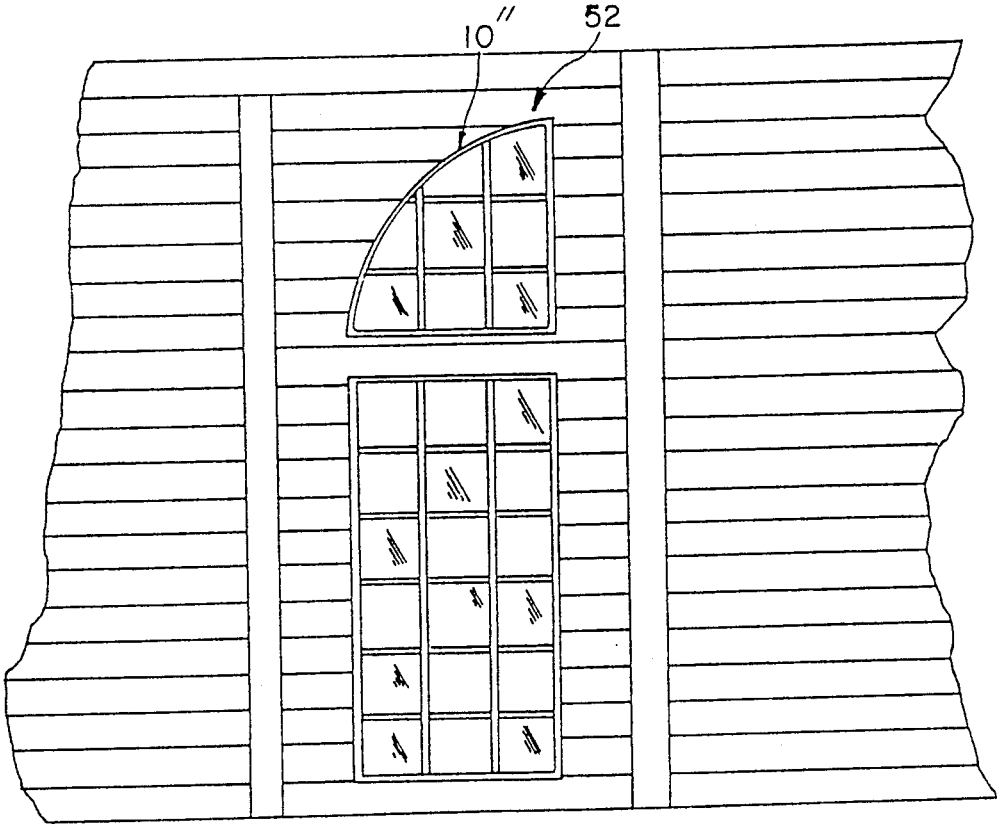
FIG. 14 is an enlarged fragmentary front elevation of a building having a modified quarter round type of an architectural window assembly mounted thereon with my multi-flanged radius drip cap.

As previously suggested herein, my radius drip cap 10" can also be shaped and used with quarter round type windows as shown at 52 in FIG. 14.

Figure 12:
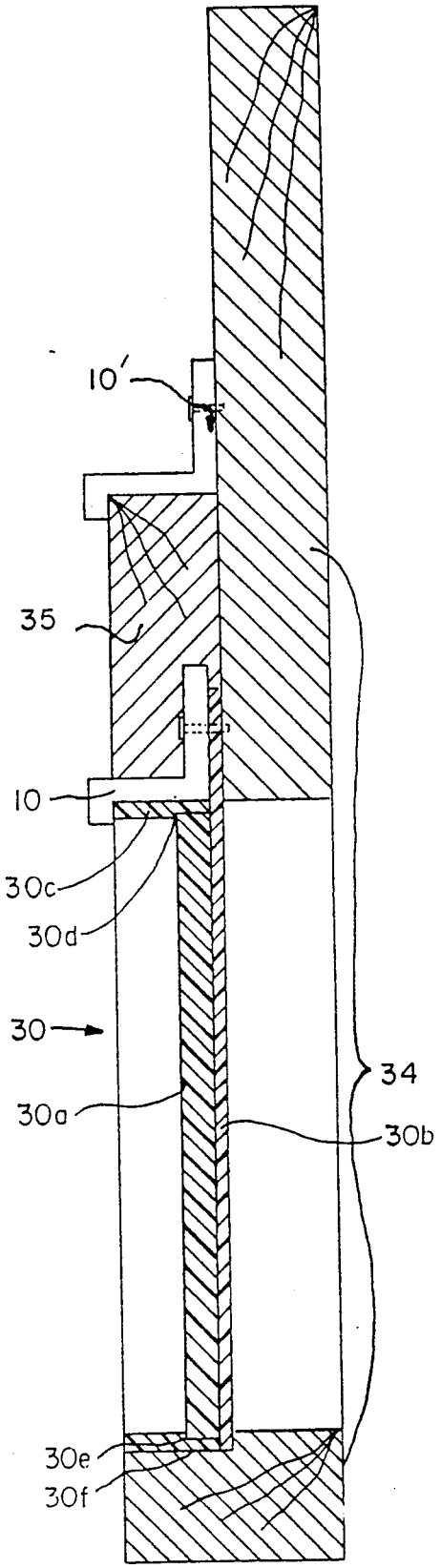
FIG. 12 is a vertical cross sectional view of the drip cap mounted on an architectural window assembly taken on the line 12—12 as looking in the direction indicated by the arrow as seen in FIG. 10.
Figure 13:
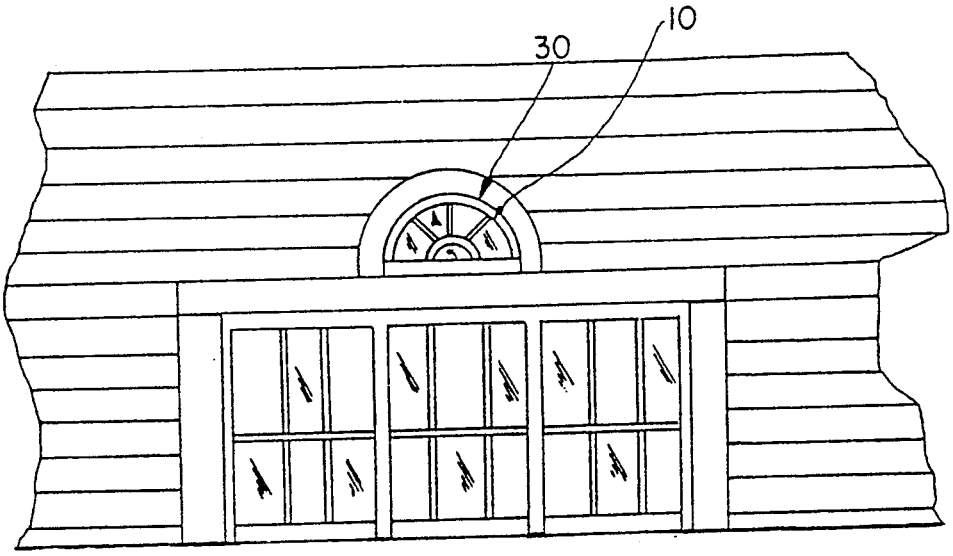
FIG. 13 is an enlarged fragmentary side elevation of a building having an architectural window assembly provided with my arcuately shaped multi-flanged radius drip caps as previously described and illustrated in preceding figures.

The window assembly 30 as seen in FIG. 10 is also illustrated in FIG. 12. Here the window assembly 30 is shown as including a synthetic plastic window stop 30*a* which serves to support window panes between the stops as further seen in FIG. 10. Mounted behind the stop or strip 30*a* is a back strip or flange of the window identified as 30*b*. In order to support the window panes in the plastic strips 30*a*, a top mounting member 30*c* underlies the previous drip cap 10 and the radius drip cap 10 is mounted thereon. It will further be seen that this radius drip cap 10 is nailed to the back strip or plastic flange 30*b* of the window and to the building wall 34 (FIG. 12). The nails are shown at 54 in FIG. 10. The top mounting member 30*c* has a notched seat 30*d* and the plastic strips 30*a* are seated in the notches to lock them in place. At the bottom edge of the window, a notched seat 30*e* similar to notched seat 30*d* is provided in the lower mounting member 30*f*. By providing seats at opposite ends of the strips 30*a*, the strips can serve to properly support the window panes. It will thus be understood that the radius drip cap 10 serves to protect these window components and particularly including the top mounting member 30*c* from moisture damage. As pointed out earlier, the caulking is not shown in FIG. 12 but it is shown in FIG. 10 at 16*a*. The outer edge of the drip cap 10 is also caulked in the same way as the caulking is illustrated at 16*a*. Thus, the nails and the caulking serve to co-act to provide a watertight joint between the radius drip cap 10 and the window assembly 30. The radius drip cap 10' has a larger radius than the radius drip cap 10 and it serves to protect the fascia structure which includes the components 36 and 38 as previously described. Nails are provided to hold the larger radius drip cap 10' to the building 34.

As described above, the drip cap 10 of the present invention provides a number of advantages, some of which have been described above and others of which are inherent in the invention. Also, modifications can be proposed to the drip cap 10 without departing from the teachings herein. Accordingly, the scope of the invention is only to be limited as necessitated by the accompanying claims.

I claim:

1. In a building having an architectural window assembly mounted thereon with a round exterior trim attached to a building wall about the window assembly, the improvement of an arcuately shaped multi-flanged radius drip cap in attachment with siding covering the building wall, the drip cap being comprised of a metallic material, the arcuately shaped radius drip cap comprised of one piece and having a pair of spaced apart radially inner and outer curved flanges and an intermediate curved flange integrally joined with the pair of spaced apart flanges at opposite front and back areas of the intermediate flange, the radially outer flange having a series of radially extending slits, each of the slits having a watertight caulking compound providing water dams to prevent fluid flow through the slits in the radially outer curved flange, and attachment means attaching the radius drip cap to the siding covered building wall with the radius drip cap protectively encasing the round exterior trim to inhibit water leakage to the trim and to the architectural window assembly.

2. The building having the architectural window assembly of claim 1 wherein said arcuately shaped multi-flanged radius drip cap is shaped having a quarter round shape.

3. The building having the architectural window assembly of claim 1 wherein said arcuately shaped multi-flanged radius drip cap is shaped having a half round shape.

4. The building having the architectural window assembly of claim 1 wherein said radially inner flange has arcuately spaced channels extending transversely of said radially timer flange.

5. The building having the architectural window assembly of claim 4 wherein said channels are in radial alignment with said water dams provided on said radially outer flange.

6. The architectural window assembly of claim 1 wherein said attachment means includes nails.

7. An arcuately shaped multi-flanged radius drip cap for attachment with a siding covered building wall, the drip cap being comprised of a metallic material, the arcuately shaped radius drip cap comprised of one piece and having a pair of spaced apart radially inner and outer curved flanges and an intermediate curved flange integrally joined with the pair of spaced apart flanges at opposite front and back areas of the intermediate flange, the radially outer flange having a series of radially extending slits, each of the slits having a watertight caulking compound providing water dams to prevent fluid flow through the slits in the radially outer curved flange.

8. The arcuately shaped multi-flange radius drip cap of claim 7 wherein said arcuately shaped multi-flanged radius drip cap has a quarter round shape.

9. The arcuately shaped multi-flange radius drip cap of claim 7 wherein said arcuately shaped multi-flanged radius drip cap has a half round shape.

10. The arcuately shaped multi-flange radius drip cap of claim 7 wherein said radially inner flange has arcuately spaced channels extending transversely of said radially inner flange.

11. The arcuately shaped multi-flange radius drip cap of claim 10 wherein said channels being in radial alignment with said water dams provided on said radially outer flange.

12. In a building wall having an architectural window assembly mounted thereon with a round exterior window trim attached to the building wall about the window assembly and with a roundish decorative fascia board structure positioned radially outwardly of the round exterior window trim, the improvement of a first arcuately shaped multi-flanged radius drip cap in attachment with the siding covered building wall covering a radially outer exterior window trim, the drip cap being comprised of a metallic material, the arcuately shaped radius drip cap comprised of one piece and having a pair of spaced apart radially inner and outer curved flanges and an intermediate curved flange integrally joined with the pair of spaced apart flanges at opposite front and back areas of the intermediate flange, the radially outer flange having a series of radially extending slits, each of the slits having a watertight caulking compound providing water dams to prevent fluid flow through the slits in the radially outer curved flange, first attachment means attaching the radius drip cap to the siding covered building wall with the radius drip cap protectively encasing the round exterior trim to inhibit water leakage to the trim and to the architectural window assembly and a second arcuately shaped multi-flanged radius drip cap having a greater radius than said first arcuately shaped multi-flanged radius drip cap, said second cap having caulked slits, and a second attachment means attaching said second arcuately shaped multi-flanged radius drip cap in protective sealed relationship on the round decorative fascia board in water sealed protective assembly therewith.

13. In a building having an architectural window assembly mounted thereon with a round exterior trim attached to a building wall about the window assembly, the improvement of an arcuately shaped multi-flanged radius drip cap in attachment with siding covering the building wall, the drip cap being comprised of a metallic material, the arcuately shaped radius drip cap comprised of one piece and having a pair of spaced apart radially inner and outer curved flanges and an intermediate curved flange integrally joined with the pair of spaced apart flanges at opposite front and back areas of the intermediate flange, said radially inner flange having arcuately spaced channels extending transversely of said flange and sized for window abutment, said channels providing an arcuate shape to the radially inner curved flange of the drip cap, and attachment means attaching the radius drip cap to the siding covered building wall with the radius drip cap protectively encasing the round exterior trim to inhibit water leakage to the trim and to the architectural window assembly.

14. The building having the architectural window assembly of claim 13 wherein said arcuately shaped multi-flanged radius drip cap is shaped having a quarter round shape.

15. The building having the architectural window assembly of claim 13 wherein said arcuately shaped multi-flanged radius drip cap is shaped having a half round shape.

16. An arcuately shaped multi-flanged radius drip cap for attachment with a siding covered building wall, the drip cap being comprised of a metallic material, the arcuately shaped radius drip cap comprised of one piece and having a pair of spaced apart radially inner and outer curvature flanges and an intermediate curved flange integrally joined with the pair of spaced apart flanges at opposite front and back areas of the intermediate flange, the radially outer flange having a series of radially extending slits, said radially inner flange having arcuately spaced crimped areas comprising water deflectors extending transversely of said radially inner flange for engagement against window frames to minimize water leakage into a building.

17. The arcuately shaped multi-flange radius drip cap of claim 16 wherein said arcuately shaped multi-flanged radius drip cap has a quarter round shape.

18. The arcuately shaped multi-flange radius drip cap of claim 16 wherein said arcuately shaped multi-flanged radius drip cap has a half round shape.

19. In a building wall structure having an architectural window assembly mounted thereon with a round exterior window trim attached to the building wall about the window assembly and with a roundish decorative fascia board structure positioned radially outwardly of the round exterior window trim, the improvement of a first arcuately shaped multi-flanged radius drip cap in attachment with the siding covered building wall covering a radially outer exterior window trim, the drip cap being comprised of a metallic material, the arcuately shaped radius drip cap comprised of one piece and having a pair of spaced apart radially inner and outer curved flanges and an intermediate curved flange integrally joined with the pair of spaced apart flanges at opposite front and back areas of spaced apart flanges at opposite front and back areas of the intermediate flange, the radially outer flange having a series of radially extending slits, said radially inner flange having arcuately spaced channel shaped areas comprising crimps extending transversely of said radially inner flange, at least of some of said channel shaped areas acting as water deflectors for allowing water to be deflected away from the radius strip cap and the window frame, and first attachment means attaching the radius drip cap to the siding covered building wall with the radius drip cap protectively encasing the round exterior trim to inhibit water leakage through to the architectural window assembly.

20. The building wall structure of claim 19 wherein a second arcuately shaped multi-flanged radius drip cap is provided having a greater radius than said first arcuately shaped multi-flanged radius drip cap, said second cap having channel shaped areas comprising crimps, and a second attachment means attaching said second arcuately shaped multi-flanged radius drip cap in protective mounted relationship on the round decorative fascia board in water sealed protective assembly therewith.

21. An arcuately shaped multi-flanged drip cap for attachment with a siding covered building wall, the arcuately shaped radius drip cap comprised of one piece and having a pair of spaced apart radially inner and radially outer curved flanges and an intermediate curved flange integrally joined with the pair of spaced apart flanges at opposite front and back areas of the intermediate flange, the radially outer flange having a series of radially extending slits, each of the slits having means providing a closure thus providing water dams to prevent fluid flow through the slits in the radially outer curved flange.

22. The arcuately shaped multi-flange radius drip cap of claim 2 wherein said arcuately shaped multi-flanged radius drip cap has a quarter round shape.

23. The arcuately shaped multi-flange radius drip cap of claim 21 wherein said arcuately shaped multi-flanged radius drip cap has a half round shape.

24. The arcuately shaped multi-flange radius drip cap of claim 21 wherein said radially inner flange has arcuately spaced upright channels extending transversely of said radially inner flange.

25. The arcuately shaped multi-flange radius drip cap of claim 24 wherein said upright channels are in radial alignment with said water dams provided on said radially outer flange.

26. The arcuately shaped multi-flange radius drip cap of claim 21 wherein said radially inner flange has arcuately shaped crimped areas comprising water deflectors extending transversely of said radially inner flange for engagement against window frames to minimize water leakage into a building.

27. The arcuately shaped multi-flange radius drip cap of claim 26 wherein the slits and the crimped areas are in radial alignment with one another when mounted on a roundish architectural window assembly.

28. The arcuately shaped multi-flange radius drip cap of claim 24 wherein said radially inner flange has arcuately shaped crimped areas comprising water deflectors, said water deflectors being channel shaped and extending transversely of said radially inner flange for engagement against window frames to minimize water leakage into a building.

29. The arcuately shaped multi-flange radius drip cap of claim 21 wherein each of the slits are generally of a V-shape with a bottom of the V being located in closest adjacency to said intermediate curved flange, a widest part of each of the V-shape slits opening radially outwardly of said radially outer curved flange leaving an outer most edge of the radially curved flange interrupted at arcuately spaced intervals by the widest part of the V-shape openings defined by the slits.

30. The arcuately shaped multi-flanged radius drip cap of claim 21 wherein said radially inner flange has arcuately shaped crimped areas comprising water deflectors, said water deflectors being channel shaped and extending transversely of said radially inner flange for engagement against window frames to minimize water leakage into a building, the slits and the crimped areas are in radial alignment with one another when mounted on a roundish architectural window assembly.

31. An arcuately shaped multi-flanged radius drip cap for attachment with a siding covered building wall, the arcuately shaped radius drip cap comprised of one piece and having a pair of spaced apart radially inner and radially outer axially extending curved flanges and an intermediate radially extending curved flange integrally joined with the pair of spaced apart axially extending flanges at opposite front and back areas of the intermediate flange, the radially outer flange having a series of radially extending slits, each of the slits are generally of a V-shape with a bottom of the V being located in closest adjacency to said intermediate curved flange, a widest part of each of the V-shape slits opening radially outwardly of said radially outer curved flange leaving an outer most edge of the radially outer curved flange interrupted at arcuately spaced intervals by the widest part of the V-shape openings defined by the slits, the radially inner axially extending flange having a series of radially extending ribbed areas leaving the flange unbroken as a solid water barrier.

32. The arcuately shaped multi-flanged radius drip cap of claim 31 wherein the slits and the ribbed areas are in radial alignment with one another when mounted on an architectural window assembly.

33. The arcuately shaped multi-flanged radius drip cap of claim 31 wherein said ribbed areas comprising water deflectors, said water deflectors being channel shaped and extending transversely of said radially inner flange for engagement against window frames to minimize water leakage into a building, the slits and the crimped areas are in radial alignment with one another when mounted on a roundish architectural window assembly.

34. In an architectural window assembly including a round frame structure, the improvement of an arcuately shaped multi-flanged radius drip cap for attachment with a siding covered building wall, the arcuately shaped radius drip cap comprised of one piece and having a pair of spaced apart radially inner and radially outer axially extending curved flanges and an intermediately radially extending curved flange integrally joined with the pair of spaced apart axially extending flanges at opposite front and back areas of the intermediate flange, the radially outer flange having a series of radially extending slits, each of the slits are generally of a V-shape and opening radially outwardly of the radially outer curve flange leaving an outermost edge of the radially outer flange interrupted at arcuately spaced intervals by the widest parts of the V-shaped openings defined by the slits, the radially inner axially extending flange having a series of radially extending crimped areas leaving the flange unbroken as a solid water barrier.

35. The architectural window assembly of claim 34 wherein said crimped areas comprise water deflectors, said water deflectors being channel shaped and extending transversely of said radially inner flange for engagement against window frames to minimize water leakage into a building, the slits and the crimped areas are in radial alignment with one another when mounted on a roundish architectural window assembly.

* * * * *